US008032970B2

(12) United States Patent
Chen

(10) Patent No.: US 8,032,970 B2
(45) Date of Patent: Oct. 11, 2011

(54) BOLT BRUSH

(75) Inventor: Lung-Pao Chen, Jhubei (TW)

(73) Assignees: Sunmatch Industrial Co., Ltd., Hsinchu County (TW); Toku Pneumatic Co., Ltd., Fukuoka (JP)

( * ) Notice: Subject to any disclaimer, the term of this patent is extended or adjusted under 35 U.S.C. 154(b) by 288 days.

(21) Appl. No.: 12/425,891

(22) Filed: Apr. 17, 2009

(65) Prior Publication Data

US 2010/0263145 A1 Oct. 21, 2010

(51) Int. Cl.
*A46B 15/00* (2006.01)
*B08B 9/023* (2006.01)

(52) U.S. Cl. ..... 15/160; 15/104.04

(58) Field of Classification Search ..... 15/104.04, 15/104.03, 104.05, 106, 179, 160, 88; 403/344
See application file for complete search history.

(56) References Cited

U.S. PATENT DOCUMENTS 2,595,787 A * 5/1952 Heimann ..... 24/16 R
6,113,306 A * 9/2000 Allert ..... 403/344
6,769,151 B1 8/2004 Lin
6,964,077 B2 * 11/2005 Kadinger et al. ..... 15/104.03

* cited by examiner

*Primary Examiner* — Joseph J Hail
*Assistant Examiner* — Tyrone Hall, Jr.
(74) *Attorney, Agent, or Firm* — Leong C. Lei

(57) ABSTRACT

A bolt brush includes a housing, a scraper and a ring plate. The housing has a holding space which is provided with an opening at an end and emplaces the scraper, an inner wall of the housing, close to that opening, is surrounded with a ring groove, and a side of the scraper is provided with plural brush hairs. The ring plate is locked in the ring groove, a side of the ring plate is an opening, and more than one pick-up member is formed close to that opening.

3 Claims, 9 Drawing Sheets

BOLT BRUSH

BACKGROUND OF THE INVENTION a) Field of the Invention

The present invention relates to a bolt brush, and more particularly to a bolt brush which is capable of cleaning bolts of truck tires, and brush hairs of which can be easily dismounted upon replacing the brush hairs.

b) Description of the Prior Art

For many transportation companies, a cargo truck can be one of the important tools for making money. However, for this huge vehicle, it must spend a lot of time in maintaining, especially that as there are usually tens of tires which are responsible for supporting weight of the truck and for moving the vehicle, a significant amount of bolts will be used in connecting and fixing the tires. Moreover, after a long time of usage, when repeatedly locking the bolts and nuts after changing the tires, rust and oil stain will allow the bolts and the nuts not to be locked tightly, which will further affect safety in driving. Although changing the new bolts is one solution, as one truck will usually require tens of bolts, this solution is apparently not wise in nowadays where earth resources are in short gradually, due to that the new bolts will cost a lot, and the old bolts are not damaged in main bodies and can be still used after cleaning. Nevertheless, a conventional cleaning method is no more than using a conventional iron brush with a wood handle to finish and clean a rusty part of a threaded part of the bolt. This method not only wastes time, but also wastes manpower, which is provided with a low efficiency in terms of a modern society where every minute counts.

On the other hand, U.S. Pat. No. 6,769,151 B1 discloses a battery brush structure. Referring to FIG. 1, it shows an exploded view of a conventional battery brush, wherein the battery brush includes a body 1, an inner wall of which is provided with a rib 11, and an interior of which is emplaced with a cylindrical scraper 12. The cylindrical scraper 12 is locked and fixed in the body 1 through the rib 11, and the body 1 is provided with a fixing block 13, an interior of which is provided with a screw hole 131. The screw hole 131 is connected to a connecting rod 14. After improvement, the battery brush is suitable for cleaning truck bolts, and efficiency can be increased through assistance of electric and pneumatic tools, which is very inexpensive in cost and can save time and effort in usage. However, after using and experimenting with the original battery brush structure, the present inventor has actually found following shortcomings for improvement:

1. Although the structure can be used on the pneumatic or electric hand tool to become a brush head, when the cylindrical scraper 12 is to be replaced after using, fixing screws of the fixing block 13 and the body 1 have to be loosen and taken out by a tool, such as a screw driver, that the fixing block 13 can be separated with the body 1. Next, when the fixing block 13 is to be assembled with the body 1, corresponding screw holes on the fixing block 13 and the body 1 should be adjusted for alignment by eye sight of a user, allowing the screws to connect and fix the body 1 and the fixing block 13. This replacement method for the cylindrical scraper 12 is rather inconvenient.
2. According to the aforementioned patent, a tube-shape connector of battery electrodes is provided with a smooth surface. Therefore, it can be easily cleaned manually with that battery brush. However, to cope with a different diameter of the tube-shape connector of the battery electrodes, a cleaning space of the brush head should be designed to be larger than the electrode connector. Yet, this design cannot actually achieve the cleaning effect for the bolt, a surface of which is provided with a helical concavo-convex thread surface.

SUMMARY OF THE INVENTION

Accordingly, the present invention provides a bolt brush which can clean bolts of truck tires, with brush hairs being easily dismounted upon replacing the brush hairs.

The primary object of the present invention is to provide a bolt brush which can be used to clean bolts of truck tires. The bolt brush is constituted by a housing, a scraper and a ring plate. An interior of the housing is provided with a holding space for emplacing the scraper, an inner wall of the housing is surrounded with a ring groove for locking the ring plate, and the inner wall of the housing is provided with a rib for fixing the scraper. A side of the scraper is provided with plural brush hairs, part of which are abutted with the bolt at an end far away from the scraper, allowing the bolt to be cleaned even better. A side of the ring plate is provided with an opening which facilitates the ring plate to be locked in the ring groove, and more than one pick-up member is formed close to that opening.

Accordingly, by the aforementioned technologies, the shortcomings that exist in the conventional battery brush structure can be improved. For the conventional battery brush structure, it is very inconvenient in replacing the cylindrical scraper, and the brush head should be designed to be larger than the connector to be cleaned, as the cleaning space of the brush head should cope with the different diameter of the connector. That design cannot actually achieve the cleaning effect for the bolt, a surface of which is provided with a helical concavo-convex thread surface. By the present invention, which is provided with the very simple structures, when the scraper is to be replaced, the ring plate can be easily taken out, and in a mean time, the scraper can be taken out for replacement, by merely squeezing the ring plate through the pick-up members. Furthermore, as part of the brush hairs that are far away from the end of the scraper are abutted with the bolt, the bolt can be cleaned even better. Therefore, the practical progressiveness that the present invention can be used practically and conveniently, and can be manufactured at a low cost are achieved.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
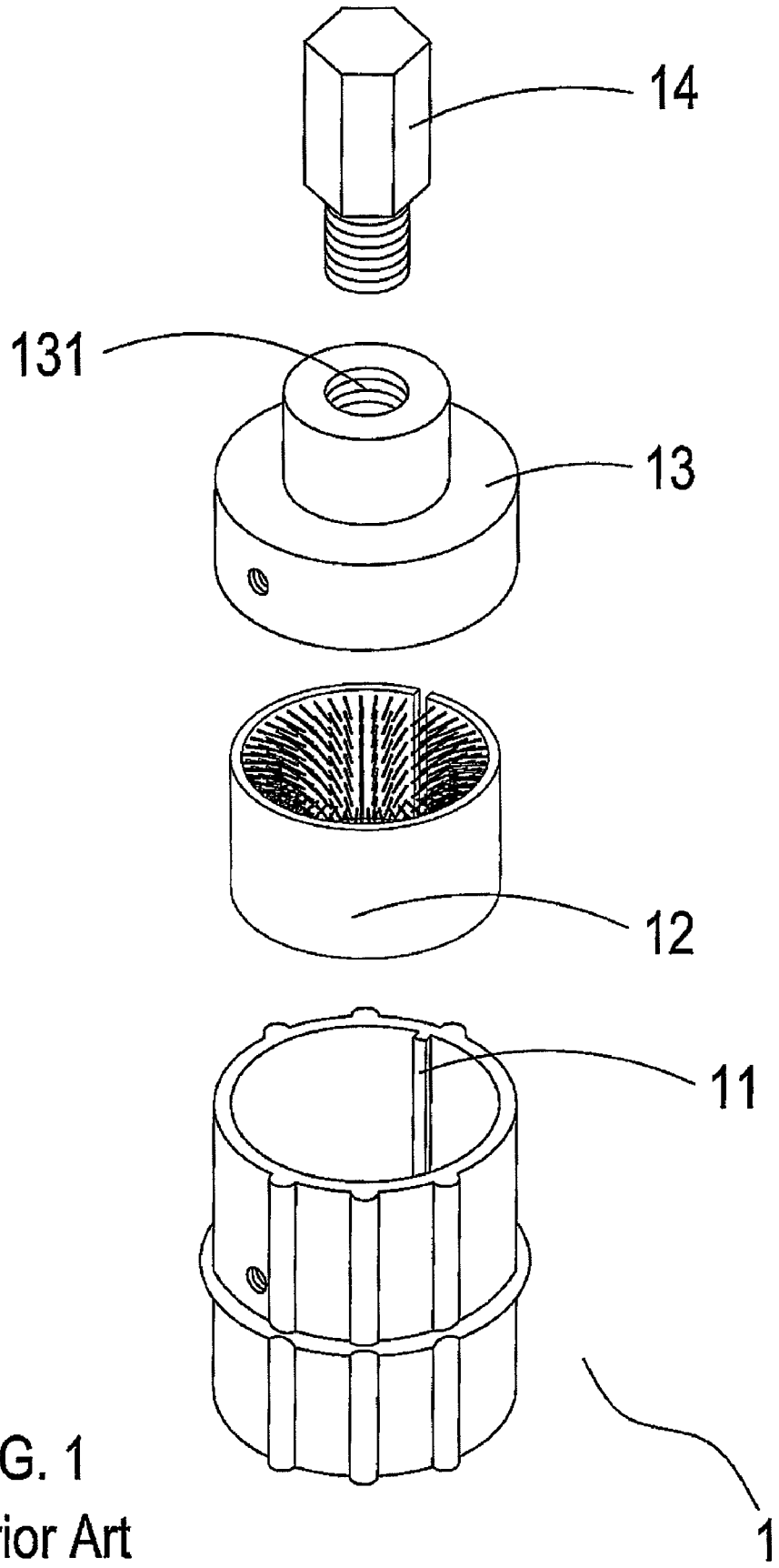
FIG. 1 Prior Art
FIG. 1 shows an exploded view of a conventional battery brush.
Figure 2:
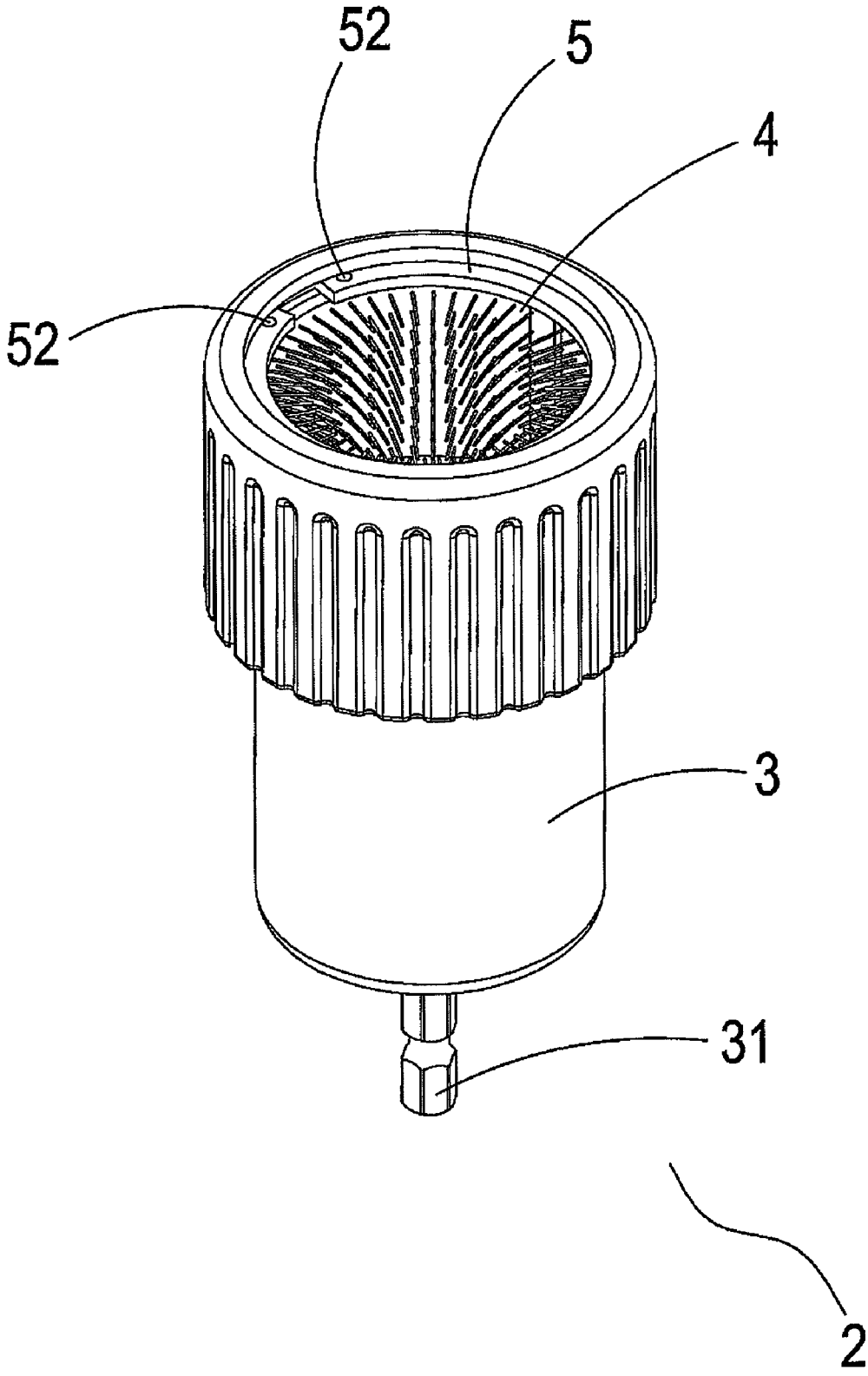
FIG. 2 shows a three-dimensional view of a preferred embodiment of the present invention.
Figure 3:
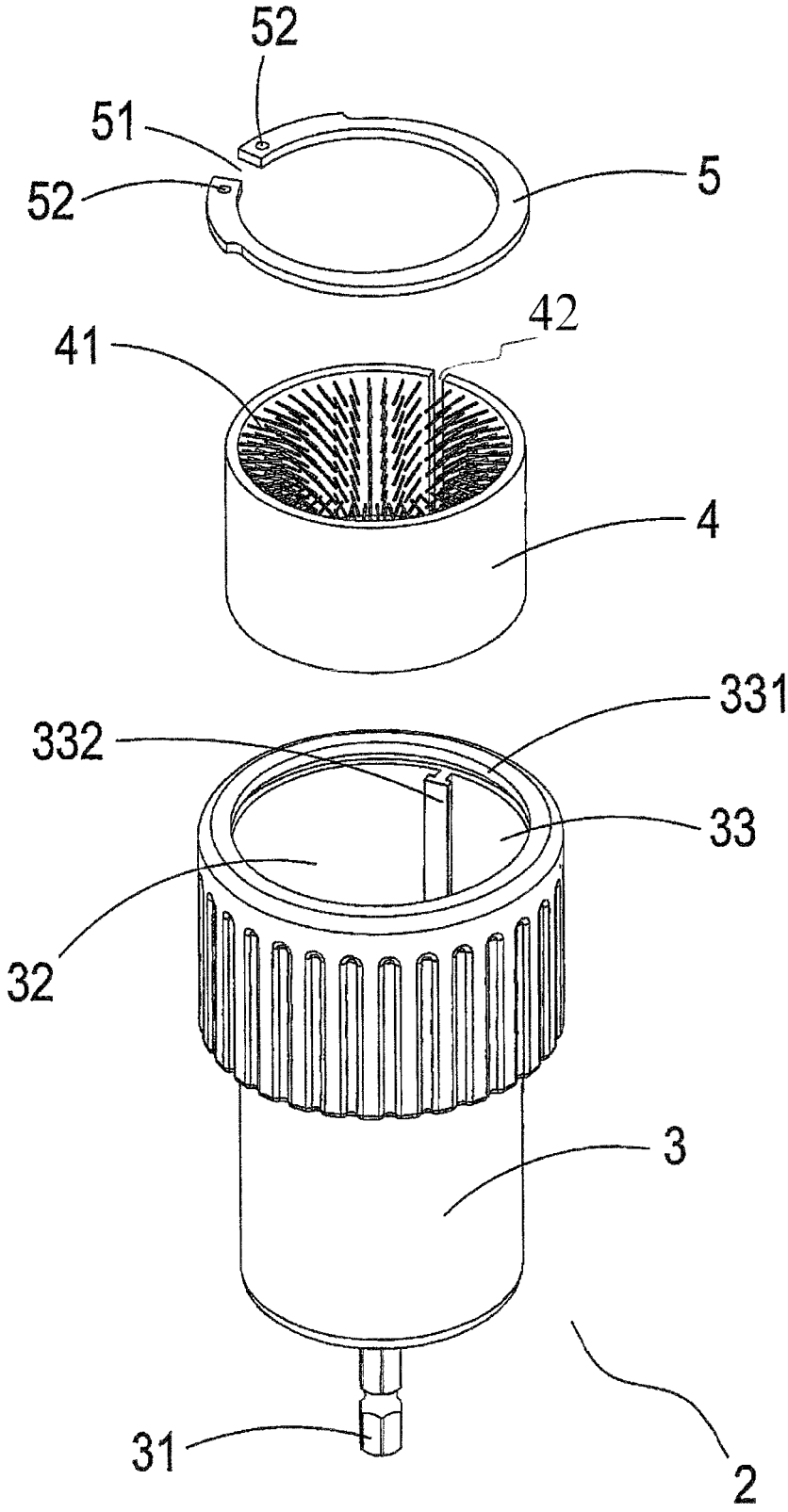
FIG. 3 shows an exploded view of a preferred embodiment of the present invention.
Figure 4:
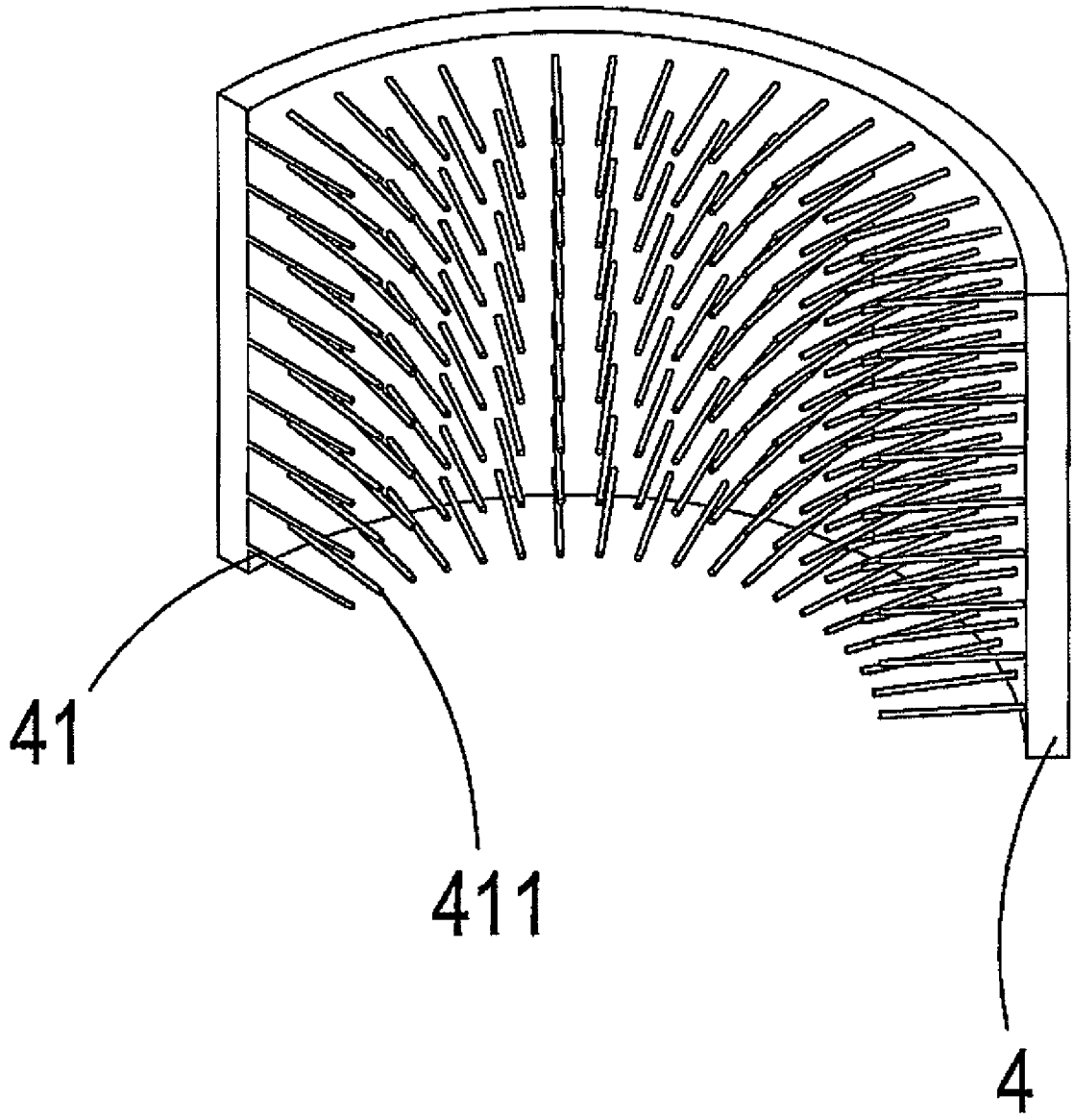
FIG. 4 shows a local schematic view of a preferred embodiment of the present invention.

Referring to FIGS. 2 to 4, it shows a three-dimensional view, an exploded view and a local schematic view of a preferred embodiment of the present invention. A bolt brush 2, which is used to clean bolts of truck tires, comprises a housing 3, an end of which is extended with a connection part 31. The connection part 31 can be a polygonal body, an interior of the housing 3 is provided with a holding space 32 having an opening at one end, and an inner wall 33 of the housing 3 is provided with a rib 332 in a T-shape configuration consisting of a radially inwardly projecting rib and an integral surface oriented tangential and parallel and spaced from a tangent of the interior wall of the housing 3. The holding space 32 contains a scraper 4 which has a longitudinal slit 42 engaged with the rib 332 so that the scraper 4 will not escape. A side of the scraper 4 is provided with plural brush hairs 41 which define contact ends 411 at an end far away from the scraper 4. The contact ends 411 are abutted at the bolt, allowing the bolt to be cleaned better. The scraper 4 is made by a flexible material, and a ring groove 331 surrounds the inner wall 33 of the housing 3, close to the opening. The ring groove 331 is emplaced with a ring plate 5 which is used to restrict and position the scraper 4, such that the scraper 4 will not escape in the housing 3. A side of the ring plate 5 is provided with an opening 51 which facilitates the ring plate 5 to be locked in the ring groove 331, and more than one pick-up member 52 is provided close to an end of the opening 51, for removing out the ring plate 5. The pick-up members 52 facilitate the ring plate 5 to be dismounted by an ordinary tool sold in a market, such that a damaged and deformed scraper can be replaced easily.

Figure 5:
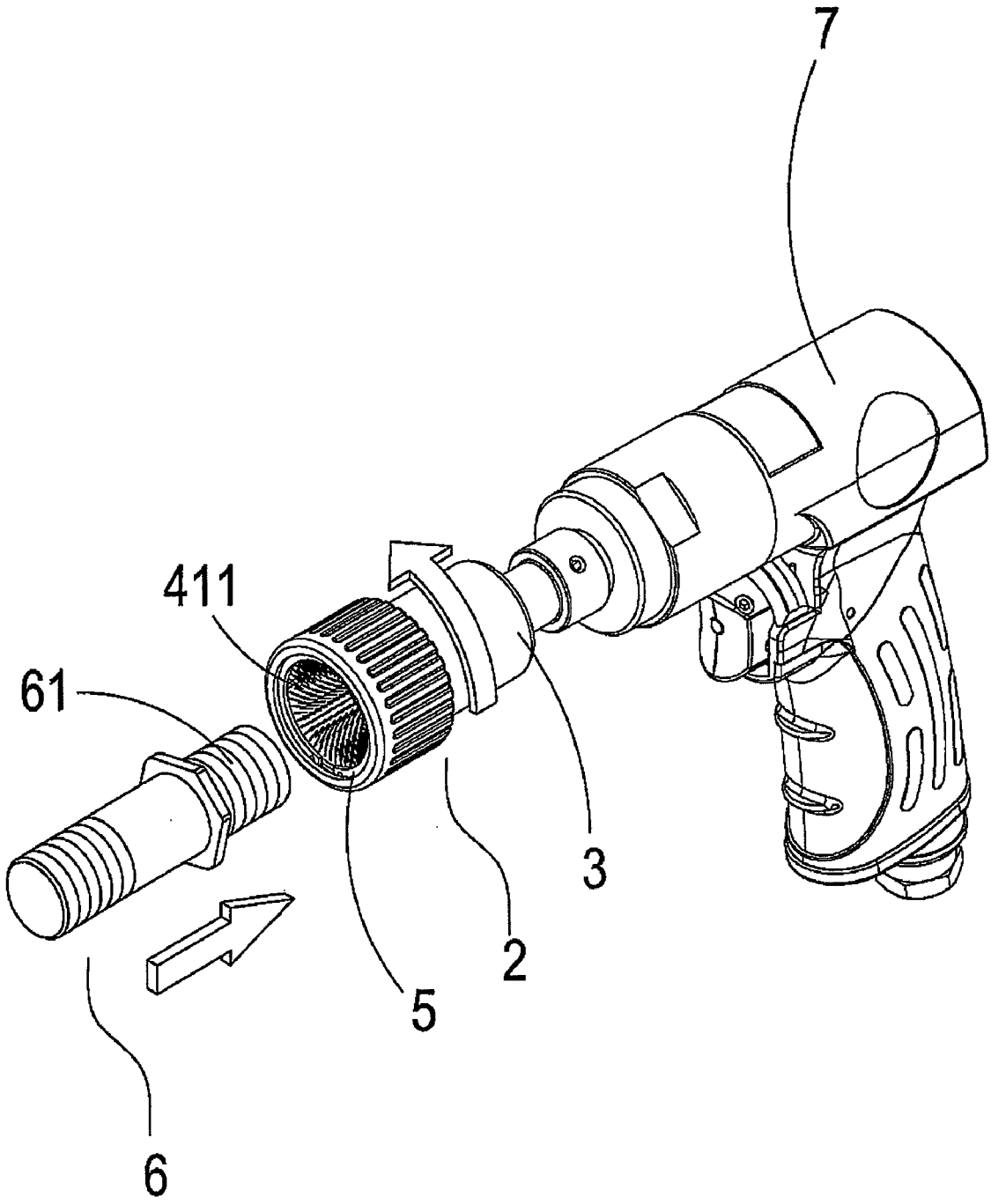
FIG. 5 shows a schematic view of an operation of a preferred embodiment of the present invention.

Referring to FIG. 3 and FIG. 5, it shows an exploded view and a schematic view of an operation, of a preferred embodiment of the present invention. The bolt brush 2 can be used to clean a bolt 6 of a truck tire and comprises the housing 3, the scraper 4 and the ring plate 5. An end of the housing 3 is extended with the connection part 31 which is connected to a driving device 7 for driving the bolt brush 2 that the bolt brush 2 is provided with a rotational force. The interior of the housing 3 is provided with the holding space 32 having the opening at one end, and the inner wall 33 of the housing 3 is provided with the rib 332 in the T-shape configuration. The holding space 32 contains the scraper 4 which is fixed in the housing 3 through the rib 332. Aside of the scraper 4 is provided with the plural brush hairs 41 which define the contact ends 411 at the end far away from the scraper 4. The contact ends 411 are abutted at the bolt 6, and when abutting, as inner diameters of the brush hairs 41 are a little smaller than an outer diameter of the bolt 6, the bolt 6 can be cleaned even better. When using the bolt brush 2 to clean the bolt 6, the bolt 6 can be cleaned even better through the contact ends 411 of the scraper 4. The ring groove 331 is locked with the ring plate 5, a side of which is formed with the opening 51 which facilitates the ring plate 5 to be locked in the ring groove 331. In addition, the bolt 6 is formed with a threaded part 61, such that when the bolt brush 2 is used to clean the bolt 6, as the contact ends 411 are abutted with the bolt 6, the scraper 4 is able to thoroughly clean the bolt 6. Moreover, when a user is to clean the bolt 6, he or she can put the bolt 6 into the scraper 4 of the bolt brush 2. At a same time, the bolt 6 is abutted with the contact ends 411 of the brush hairs 41 and then rotates along a direction of the threads of the threaded part 61 of the bolt 6. Moreover, the brush hairs 41 are also deeply abutted at notches of the threaded part 61, and then the bolt 6 can be cleaned. When the bolt 6 is cleaned by the scraper 4, as the scraper 4 is fixed by the rib 332 and is fixed in the holding space 32 through the ring plate 5, the scraper 4 will not escape while rotating. Accordingly, the advantages that the bolt brush is provided with the simple and robust structures, the bolt brush can be used practically and conveniently and can be manufactured at a low cost, are achieved.

Figure 6:
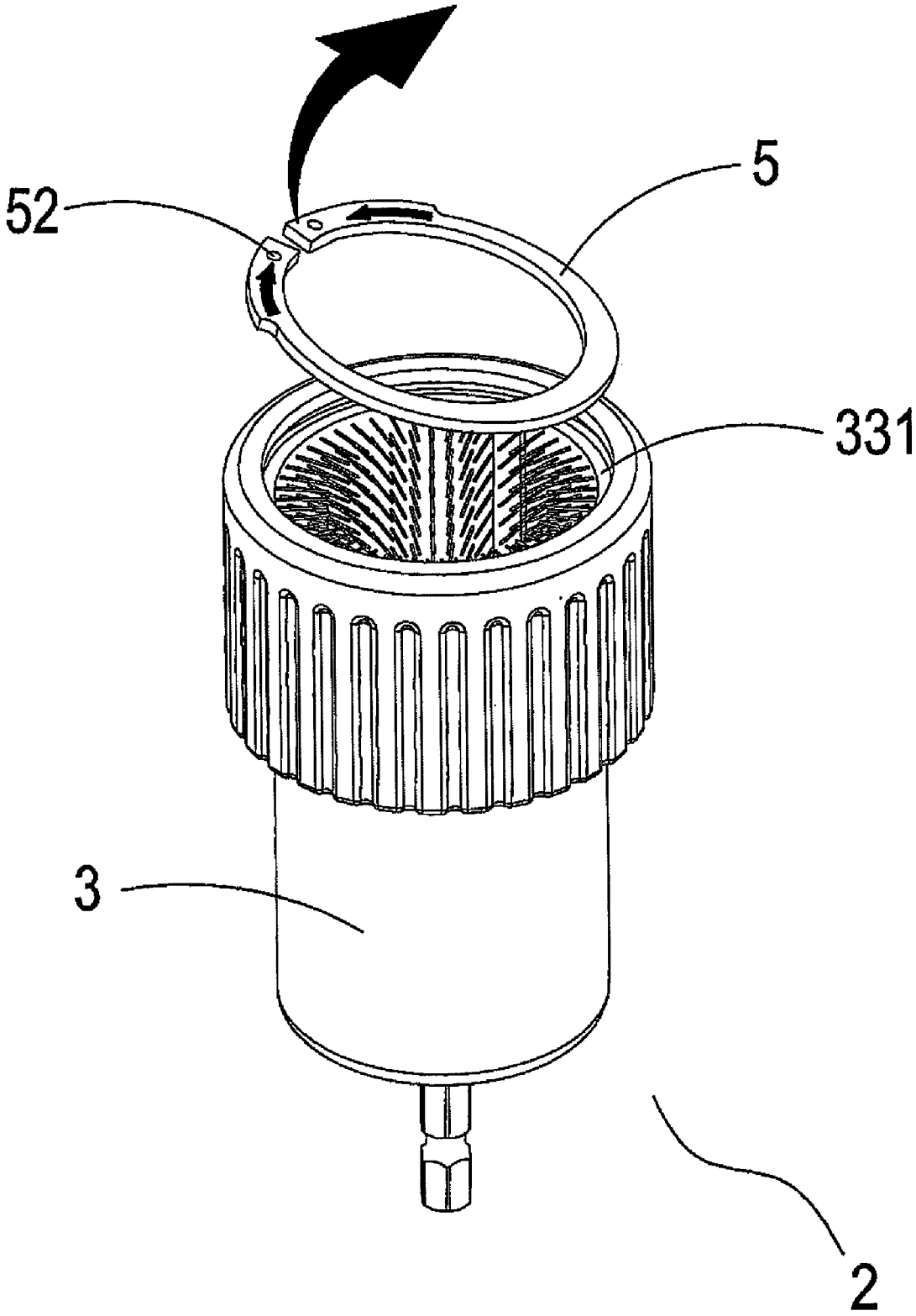
FIG. 6 shows a first schematic view of an operation of a preferred embodiment of the present invention.
Figure 7:
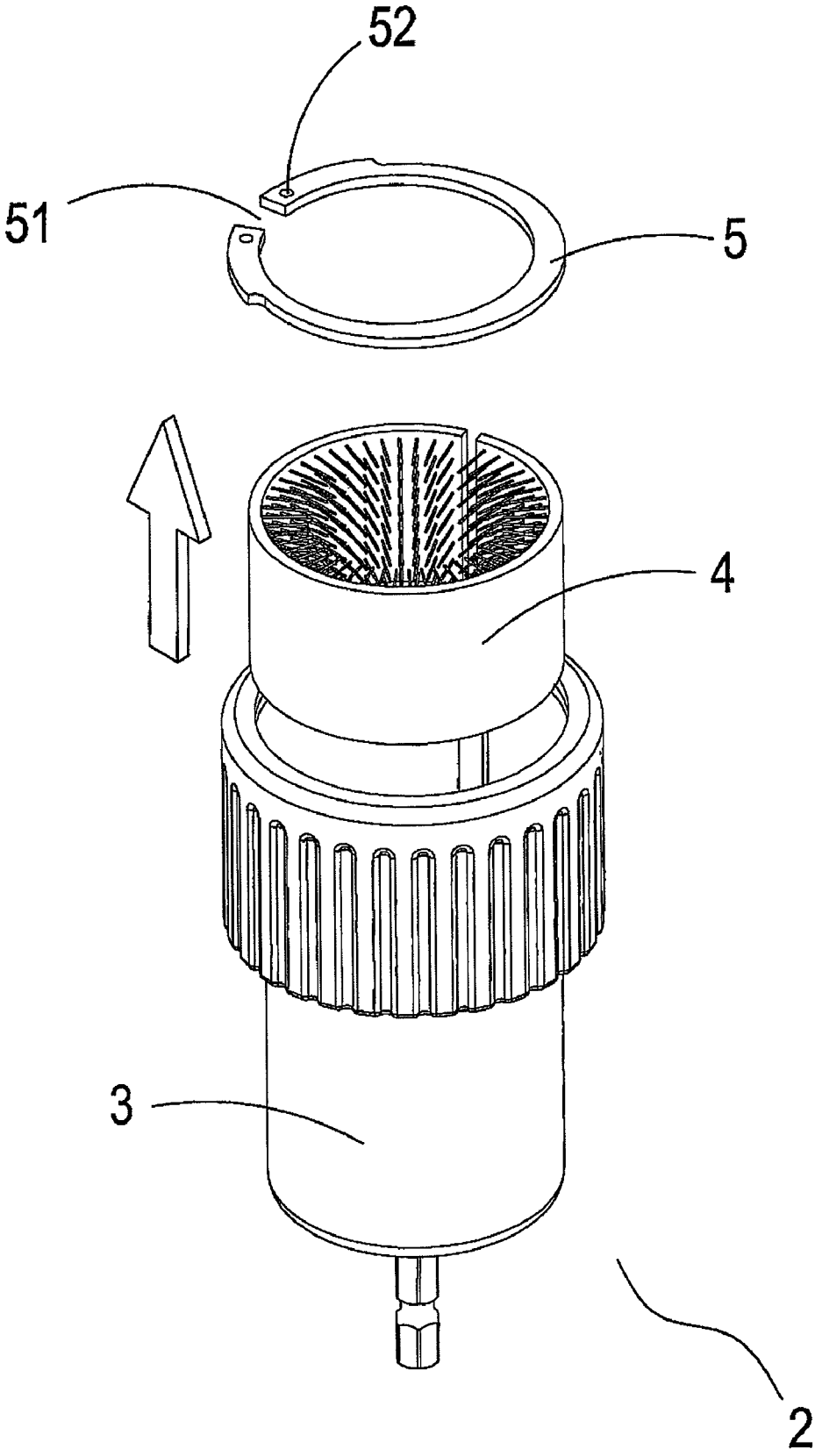
FIG. 7 shows a second schematic view of an operation of a preferred embodiment of the present invention.

Referring to FIGS. 3, 6 and 7, it shows an exploded view, a first schematic view of an operation and a second schematic view of an operation, of a preferred embodiment of the present invention. When the scraper 4 in the bolt brush 2 is to be replaced, the scraper 4 can be dismounted through the pick-up members 52. The bolt brush 2 comprises the housing 3, the ring plate 5 and the scraper 4, wherein the interior of the housing 3 is provided with the holding space 32 to emplace the scraper 4, the inner wall 33 of the housing 3 is surrounded with the ring groove 331 at a default position, the ring groove 331 is locked with the ring plate 5, a side of the ring plate 5 is formed with the opening 51 which facilitates the ring plate 5 to be locked in the ring groove 331, and more than one pick-up member 52 is formed at a proper location close to the opening 51. Accordingly, when the user is to dismount the scraper 4 for replacement, he or she uses the pick-up members 52 to exert a squeeze force onto the ring plate 5, and then the ring plate 5 can be taken out. After taking out the ring plate 5, the user can then take out the scraper 4 which is emplaced in the holding space 32, thereby achieving the effects of saving time, saving effort, being fast and convenient.

Figure 8:
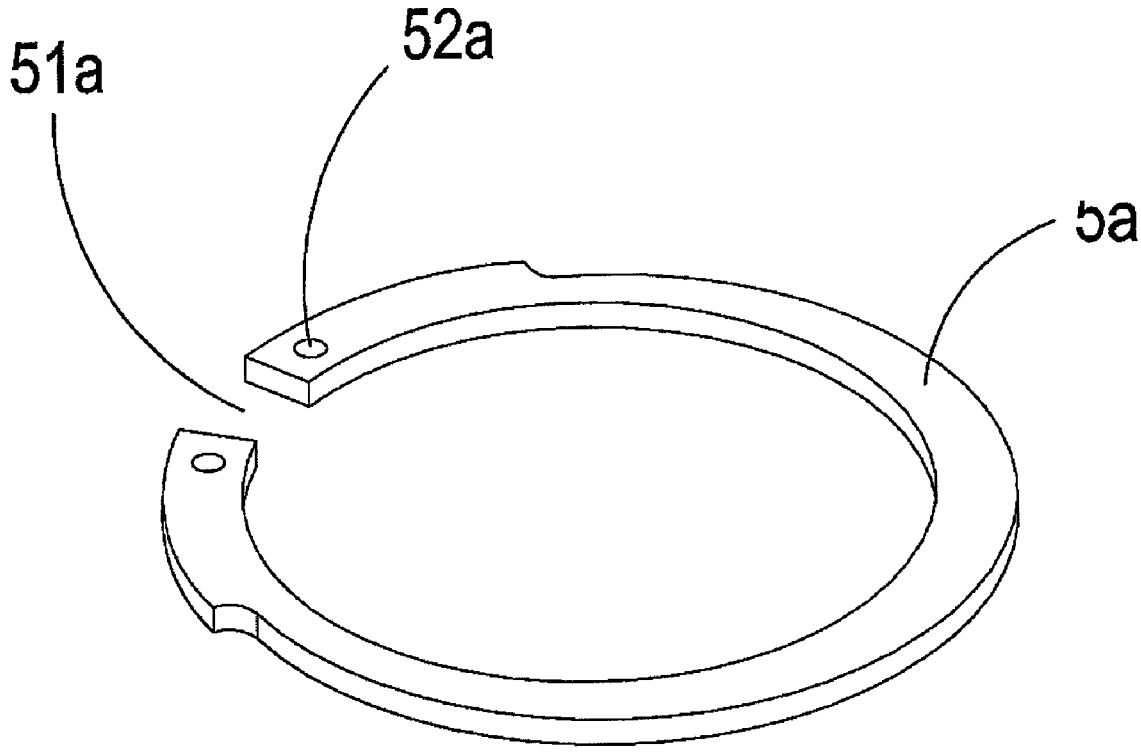
FIG. 8 shows a schematic view of an implementation of a preferred embodiment of the present invention.

Referring to FIG. 8, it shows a schematic view of an implementation of a preferred embodiment of the present invention, wherein a side of a ring plate 5*a* is formed with an opening 51*a*, and more than one pick-up member 52*a* is formed close to the opening 51*a*. The pick-up member 52*a* can be further a hole.

Figure 9:
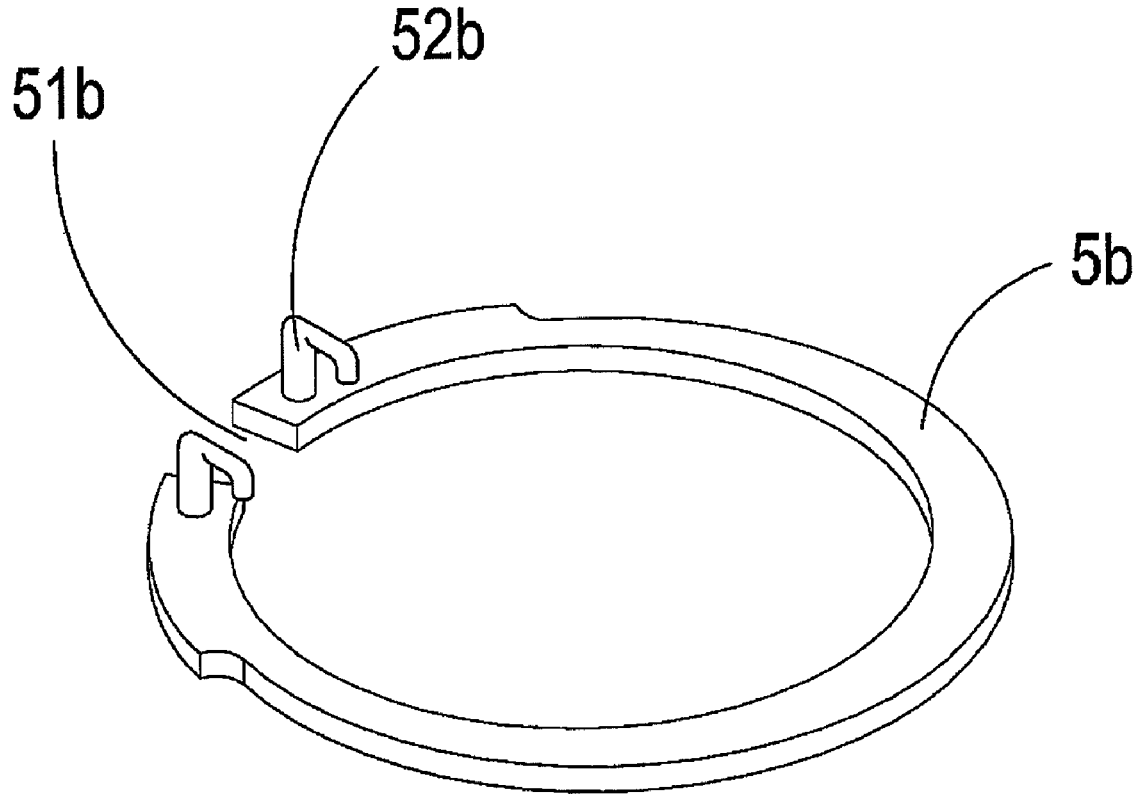
FIG. 9 shows a schematic view of an implementation of another preferred embodiment of the present invention.

Referring to FIG. 9, it shows a schematic view of an implementation of another preferred embodiment of the present invention, wherein a side of a ring plate 5*b* is formed with an opening 51*b*, and more than one pick-up member 52*b* is formed close to the opening 51*b*. The pick-up member 51*b* can be further a hook or an element for clamping.

Referring to all the drawings, the present invention is actually provided with following advantages:

1. When replacing the scraper 4, the ring plate 5, which is fixed in the scraper 4, can be taken out by merely squeezing the ring plate 5 inward through the pick-up members 52; whereas, after the ring plate 5 has been taken out, the scraper 4 can be removed easily, thereby achieving the effect of easily replacing the scraper 4.
2. The scraper 4 is fixed through the rib 332 (which is in a T-shape configuration), and the ring groove 331 is used to fix the ring plate 5 which is used to fix the scraper 4 into the holding space 32, such that the scraper 4 will not escape while rotating, thereby achieving the advantages of simple structures and easy manufacturing.
3. A side of the scraper 4 is provided with the plural brush hairs 41 which define the contact ends 411 on the brush hairs 41 at an end far away from the scraper 4. The contact ends 411 are abutted at the bolt 6. Therefore, when cleaning the bolt 6, the bolt 6 can be cleaned even better.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A bolt brush comprising:

a cylindrical housing having an end extended with a connection part, an interior of said housing being provided with a holding space having an opening, an inner wall of said housing being provided with a longitudinal T-shaped rib consisting of a radially inwardly projecting rib and an integral surface oriented tangential and parallel and spaced from a tangent of the interior surface of the housing, said cylindrical housing having an inner walls provided with a ring groove close to said opening;

a cylindrical scraper having a longitudinal slit engageable with said longitudinal T-shaped rib of said cylindrical housing thereby preventing said scraper from moving radially and laterally, said cylindrical scraper having a plurality of brush hair having contact ends far away from said scraper, and a retainer ring fitted in said ring groove of said cylindrical housing for restricting position of said scraper, said retainer ring being provided with an opening and two pick-up members formed close to said opening.

2. The bolt brush as claimed in claim 1, wherein said connection part has a polygonal body.

3. The bolt brush as claimed in claim 1, wherein said scraper is made of flexible material.

* * * * *